US006508749B1

(12) United States Patent
Broadwater

(10) Patent No.: US 6,508,749 B1
(45) Date of Patent: Jan. 21, 2003

(54) PORTABLE EXERCISE DEVICE

(76) Inventor: Ronald L Broadwater, 10 Warren Rd., Hunt Valley Medical Center, Suite 420, Cockeysville, MD (US) 21030

( * ) Notice: Subject to any disclaimer, the term of this patent is extended or adjusted under 35 U.S.C. 154(b) by 102 days.

(21) Appl. No.: 09/593,305

(22) Filed: Jun. 13, 2000

(51) Int. Cl.[7] ..... A63B 21/02
(52) U.S. Cl. ..... 482/121; 482/126
(58) Field of Search ..... 482/126, 144, 482/122, 121, 44, 907, 908, 82

(56) References Cited

U.S. PATENT DOCUMENTS

| | | | | | |
|---|---|---|---|---|---|
| 605,237 | A | | 6/1898 | Spink | |
| 704,840 | A | | 7/1902 | Korth et al. | |
| 1,010,796 | A | | 12/1911 | Pons | |
| 1,014,774 | A | | 1/1912 | Rohrer | |
| 1,623,670 | A | | 4/1927 | Frankenfeld | |
| 1,965,511 | A | | 7/1934 | Preston | |
| 3,290,043 | A | | 12/1966 | Sorensen | |
| 3,570,477 | A | | 3/1971 | Scrivner | |
| 3,606,321 | A | | 9/1971 | Macoulis | |
| 3,843,119 | A | | 10/1974 | Davis | |
| 3,910,573 | A | | 10/1975 | Jamba | |
| 3,966,204 | A | | 6/1976 | Dubach | |
| 4,093,211 | A | | 6/1978 | Hughes et al. | |
| 4,109,905 | A | | 8/1978 | Meier | |
| 4,251,071 | A | | 2/1981 | Norton | |
| 4,375,886 | A | * | 3/1983 | Muys | 482/82 |
| 4,477,073 | A | | 10/1984 | Koch et al. | |
| 4,563,002 | A | * | 1/1986 | Jardine | 482/82 |
| 4,690,401 | A | | 9/1987 | Cho | |
| 4,733,862 | A | | 3/1988 | Miller | |
| 4,779,867 | A | | 10/1988 | Hinds | |
| 4,838,547 | A | | 6/1989 | Sterlilng | |
| 4,852,874 | A | * | 8/1989 | Sleichter, III et al. | 482/121 |
| 4,909,505 | A | | 3/1990 | Tee | |
| 4,948,117 | A | | 8/1990 | Burke | |
| 5,178,591 | A | | 1/1993 | Lyons | 482/52 |
| 5,178,596 | A | | 1/1993 | McIntire | 482/80 |
| 5,186,698 | A | | 2/1993 | Mason et al. | 482/79 |
| 5,224,910 | A | | 7/1993 | Deutsch | 482/82 |
| 5,254,064 | A | | 10/1993 | Rock | 482/126 |
| 5,263,910 | A | | 11/1993 | Yang | 482/52 |
| 5,267,923 | A | | 12/1993 | Piaget et al. | 482/53 |
| 5,277,683 | A | | 1/1994 | Wilkins | 482/129 |
| 5,290,209 | A | | 3/1994 | Wilkinson | 482/38 |
| 5,318,491 | A | | 6/1994 | Houston | 482/54 |
| 5,322,490 | A | | 6/1994 | Van Der Hoeven | 482/51 |
| 5,518,481 | A | * | 5/1996 | DarKwah | 482/126 |
| 5,730,687 | A | * | 3/1998 | Ledany | 482/121 |
| 5,735,781 | A | * | 4/1998 | Pai | 482/126 |

OTHER PUBLICATIONS www.sportsbands.com (The Sport Band System).
www.simplefitnesssolutions.com (Exercise Bands).
www.gofit.net/prod/powertubes.html (Power Tubes).
www.gofit.net/prod/toningbands.html (Double Fit Pack).
www.bollingerfitness.com (Exerband and Flexband).
www.wisdomking.com/product16940c286.html (Rep Band Loop—Latex Free).
www.wisdomking.com/product16996c286.html (Can–do Exercise Band–Latex Bree).
www.wisdomking.com/line/286.html (Thera–Band Resistive Band).

* cited by examiner

*Primary Examiner*—Jerome W. Donnelly
(74) *Attorney, Agent, or Firm*—Connolly Bove Lodge & Hutz, LLP

(57) ABSTRACT

A portable exercise device is provided. The device includes an elastic cord with two ends. Each of the ends of the cord is received into opposite sides of a coupling. A clamp element is provided around a portion of the coupling. The clamp element compresses the coupling around the elastic cord to hold the cord in place inside the coupling. A handle may be provided around the coupling. The handle may be made from a resilient material so that the hand of the user may squeeze it. Additionally, end plugs may be provided for the handle to prevent the handle from slipping off the coupling.

22 Claims, 3 Drawing Sheets

PORTABLE EXERCISE DEVICE

FIELD OF THE INVENTION

The present invention relates to exercise devices, and more particularly, to a generally loop-shaped, portable exercise device with a coupling holding ends at elastic cord therein.

BACKGROUND OF THE INVENTION

Today, there is an increasing demand for new exercise devices. There is a need for a lightweight, portable exercise device that develops the arms, stomach, back and legs. Ideally, the device is adaptable to be used by all different sizes of men, women, and children.

Numerous muscle conditioning or toning devices have been devised to aid in performing different exercising routines. As an example, elastic straps, which impose a predetermined degree of resistance when stretched, are sometimes used. The elastic straps are formed into a loop and provided with rigid handle grips to be grasped by a user. However, conventional types of hand-held exercising devices have definite limitations. For example, these devices are limited with respect to the type and number of exercises that may be performed and the number of muscle groups that are exercised. Additionally, the handles tend to be either too stiff or too flexible, which causes the straps to abrade the sides of the hands.

Also a need exists for a device which provides for arm manipulation simultaneously with treadmill use. The movement of the arms on the treadmill, along with movement of the legs, can reduce the time required for a workout, while providing the same cardiovascular benefit. Additionally, there is a need for a device which is capable of accommodating handle grips which stimulate the muscles used in racquet games and golf, as well as a connection of the elastic straps which will assure the free ends of the exercise device are secured to avoid accidental loosening or separation at the ends of the device.

SUMMARY OF THE INVENTION

The present invention provides a portable exercise device. The device includes an elastic cord with two ends. Each of the ends of the cord is received into opposite sides of a coupling. A clamp element is provided around a portion of the coupling. The clamp element compresses the coupling around the elastic cord to hold the cord in place inside the coupling.

In a preferred embodiment, a handle is provided around the coupling. The handle may be made from a resilient material so that the hand of the user may squeeze it. Additionally, end plugs may be provided for the handle to prevent the handle from slipping off the coupling.

BRIEF DESCRIPTION OF THE DRAWINGS

The present invention will now be further described in that the following pages of the specification, when taken in conjunction with the attached drawings, in which.

DETAILED DESCRIPTION OF THE INVENTION

The present invention provides a portable exercise device. In one embodiment, the device includes an elastic cord having two ends. The ends of the cord are received in a coupling or hollow tube to form a loop. The ends of the elastic cord are held in place inside of the hollow tube by clamp elements. Preferably, a handle is provided around the hollow tube. The loop of elastic material may be attached to a treadmill or be looped around a stationary object, such as the users foot. The user grasps the handle and the elastic cord is stretched to exercise the desired muscle group. Additionally, the handle may be formed from a resilient material, which may be squeezed by the user's hand to exercise the hand and/or forearm muscles.

A preferred embodiment of the invention will now be described with reference to FIGS. 1*a* and 1*b*. A loop 10 is formed from a cord 12. The cord 12 is preferably made from a latex or rubber-like elastomeric material and is of a tubular cross-section. The cord 12 should provide a predetermined degree of resistance when stretched. As an example, a "bungee" cord will provide the desired results. The cord 12 can vary in strength and cords that provide approximate weight resistances of 10–15, 15–20, 20–25, and 35 pounds, as well as other strengths, may be used. Cords having different resistances may be of different colors in order to distinguish them. The thickness of the cord 12 will depend on the modulus of elasticity and the stretch resistance desired. Also, depending on user requirements, the cord 12 will have varying lengths and may be, for example, about 60 inches in length. Of course, a shorter of longer cord may be used.

Figure 2:
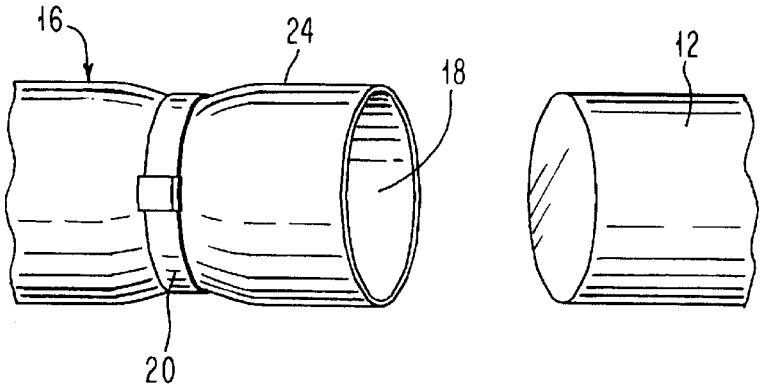
FIG. 2 is an exploded view of one end of the coupling and cord.

The cord 12 terminates in free ends 14, 15 that are merged with a coupling 16 to form an endless loop. The coupling 16 may be a hose or tube with a hollow or inner bore 18 extending longitudinally there through. The coupling 16 is preferably made from a semi-rigid rubber hose, which will deform when sufficient force is applied, for example, a neoprene rubber hose available through McMaster-Carr Supply Company and shown on page 137 of their catalog #105. The coupling 16 should be sized to receive the ends 14, 15 of the cord 12 and the inner bore 18 should have a diameter slightly larger than the diameter of the cord 12 to receive ends 14, 15, please see FIG. 2. In a preferred embodiment, the hose 12 is approximately four-five inches long, and the inner bore 18 has a diameter of approximately ¼ inch. The outside diameter of the hose will be slightly larger than the diameter of the inner bore 18, for example 9/16 inch.

Figure 1A:
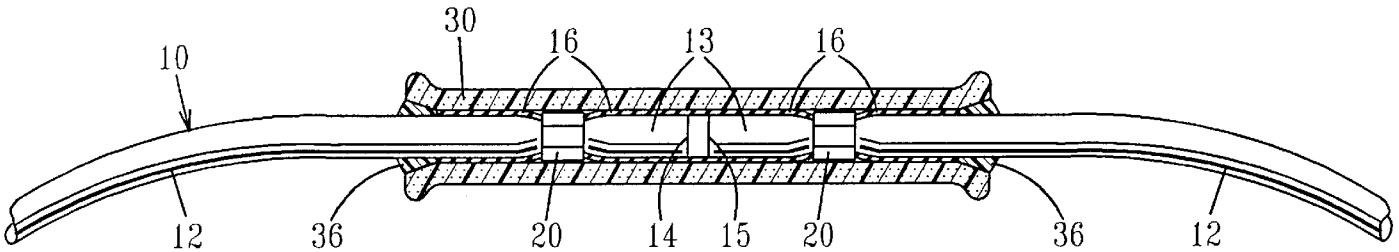
FIGS. 1*a* and 1*b* are cross-sections of a device according to the invention.
Figure 1B:
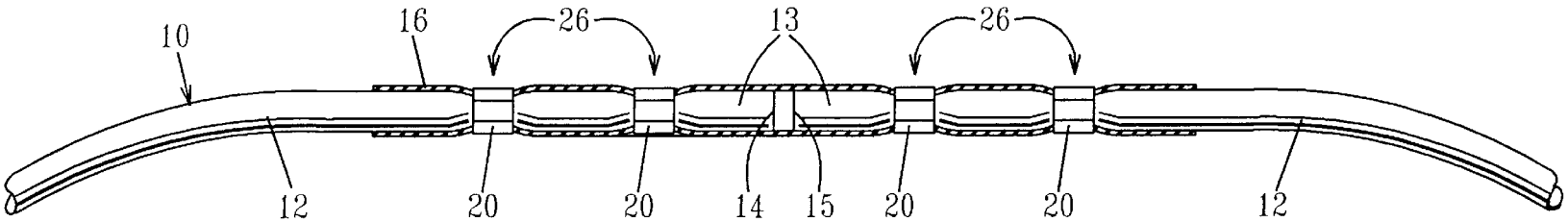

As shown in FIG. 1*a*, ends 14, 15 of the cord 12 are inserted into the inner bore 18 at opposite sides of the coupling 16. The cord 12 should be inserted into the coupling 16 so that the ends of the cord 12 are close to or touch each other at the center of the hose. Clamp elements 20 are provided to secure the cord 12 inside the hose. At least one clamp element 20 is preferably used for each end 14, 15 of the cord 12 as shown in FIG. 1*a*. The clamp element 20 is arranged around the outer surface 24 of the hose and should encircle the coupling 16. The clamp element 20 is tightened around the coupling 16 and should compress the inner bore 18 of the coupling 16 around the cord 12, holding the cord 12 in place as shown in FIG. 1*b*. The clamp element 20 should be positioned on the outer surface 24 of the coupling 16 so that ends 14, 15 of the cord 12 extend beyond the clamp element 20, into the inner bore 18. Preferably, the clamp element 20 is arranged adjacent to ends of the coupling 16.

As mentioned above, the coupling 16 is made from a flexible material so that it can be compressed around the cord 12. When the clamp element 20 is tightened, as shown in FIG. 1*b*, the hose is compressed and the diameter of the inner bore 18 is reduced in an area 26 in the region of the clamp element 20. This reduction in diameter secures the cord 12 in the hose. An additional securing force may be provided by having the cord 12 extend beyond the clamp element 20 into the inner bore 18. This extension portion 13 of the cord 12 is not compressed by the clamp element 20 and maintains its original diameter. Therefore, the extension portion 13 should prevent the cord 12 from being pulled back through the area 26 of the coupling having its diameter reduced by the clamp element 20. This embodiment of the invention prevents accidental loosening or separation of the cord 12 from the coupling 16 when the cord 12 is stretched during use of the device. Moreover, any number of clamp elements 20 may be used to ensure the cord 12 is secured in the coupling 16. This may be desirable when using a cord 12 which provides a larger weight resistance, which, in turn, will be subject to larger forces. FIG. 1*b* illustrates an embodiment of the invention using four clamp elements 20, two for each end of cord 12.

Figure 3:
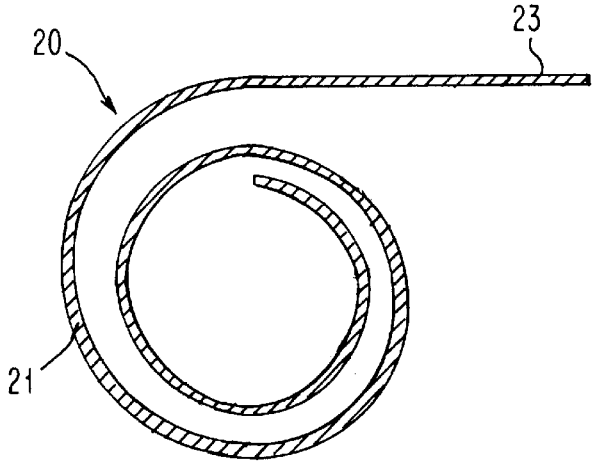
FIG. 3 is a detail of the clamp element.

Turning now to FIG. 3, a detail of the clamp element will now be described. The clamp element 20 may be a center punch hose clamp of a known type, for example the Center-Punch preformed clamp available through McMaster-Carr Supply Co. and shown on page 151 of their catalog. The clamp element 20 is formed from a metal strip 21 formed into a loop around coupling 16. To provide sufficient strength, the metal strip 21 should form at least two loops around the coupling 16. An end 23 of the metal strip 21 can be pulled down to tighten the clamp element 20 around the coupling 16. A securing element 21 is fit around the loops of metal strip 21 to hold the clamp element 20 in its tightened state. After the clamp element 20 is tightened, the end 23 of the metal strip 21 may then be cut off, resulting in the substantially circular clamp element 20 shown in FIGS. 1*a* and 1*b*.

To facilitate use of the device, a handle 30 may be provided for the user to grip. The handle 30 preferably encloses the coupling 16. Thus, the size of the handle 30 will vary to accommodate different sizes of couplings. In the embodiment described above, the handle 30 will be approximately 4½–5½ inches long, with a hollow center core, approximately ½ inch or so in diameter, to fit around the outer surface 24 of the coupling 16. In a preferred embodiment, the handle 30 is formed from a foam material. This allows the handle 30 to be squeezed to exercise and strengthen the hand and forearm muscles while the device is being used. Additionally, a barrier 34, such as electrical duct, cloth, or shrink-wrap material, or combination thereof may be wrapped around the clamp elements. This will prevent the clamp element 20, which may be metal and have sharp edges, from damaging the handle 30. Also, the barrier 34 adds stiffness to the handle 30 and prevents the handle 30 from over-flexing and bending during use.

Figure 4:
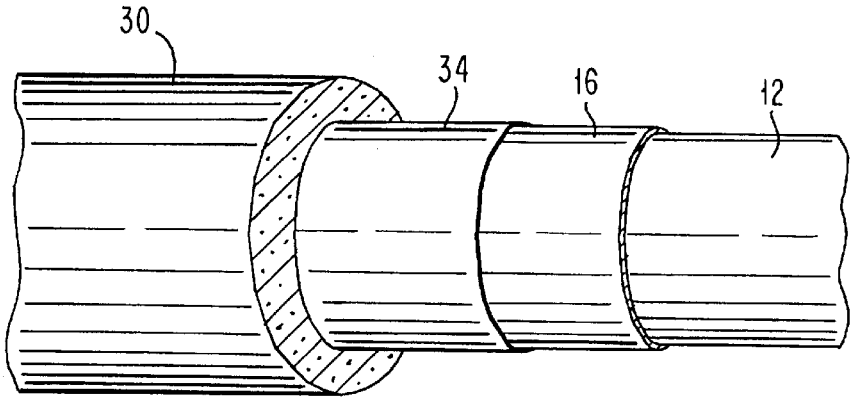
FIG. 4 is an exploded view of a grip according to the invention.

In a preferred embodiment, barrier 34 is formed from heat shrinkable tubing. The heat-shrinkable tubing preferably surrounds the entire coupling 16. FIG. 4 illustrates barrier 34 embodied as heat-shrinkable tubing. The tubing initially has an inner diameter larger than the outer diameter of the coupling. The tubing then follows the contour of the coupling 16 and the clamp elements 20. Ideally, the tubing will slightly bend the coupling 16 such that the clamp elements 20 will naturally face away from a user's hand when grasping the handle. Heat is applied to the tube, shrinking it around the coupling. The type of heat-shrinkable tube selected should be semi-rigid after shrinking and prevent the handle from flexing excessively during use. Barrie 34 may also be segments of duct tape laid lengthwise along the coupling 16.

Additionally, end plugs 36 may be provided in each end of the center core of the handle 30. The end plugs 36 prevent the handle 30 from sliding off the coupling 16 and prevent the ends of the cord from scraping the sides of the handle 30 during operation of the device. The end plugs 36 may be formed from a rubber-like or plastic material and should be substantially cylindrical in shape and have a hollow bore. A groove may be provided in the hollow bore to help secure the end plug in place. A first end of the bore has a diameter approximately the same as the diameter of the cord 12. A second end of the bore has a diameter about the same as the coupling 16 may be arranged around the end of the coupling 16. In this case, the clamp element 20 will be arranged around the outer surface 24 of the coupling 16 beyond the region covered by end plug 36. When assembling the device, each of the end plugs 36 and the handle 30 should be slid onto the cord 12 before the ends 14, 15 of the cord 12 are secured in the coupling 16. Furthermore, the end plugs 36 and handle 30 may be glued or otherwise secured in place to prevent these components from being loosened during operation of the device. Also, barrier 34, i.e. tape and/or heat-shrinkable tubing, may also be arranged around end plugs 36 to further hold the device together.

Figure 5:
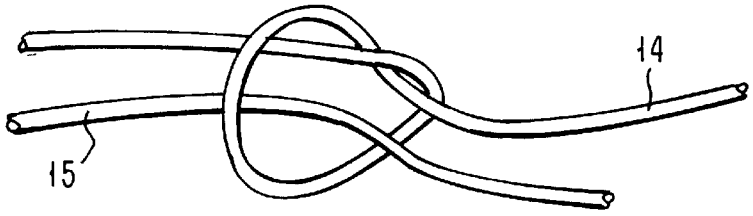
FIG. 5 is an illustration of a step in forming a knot used in the invention.
Figure 6:
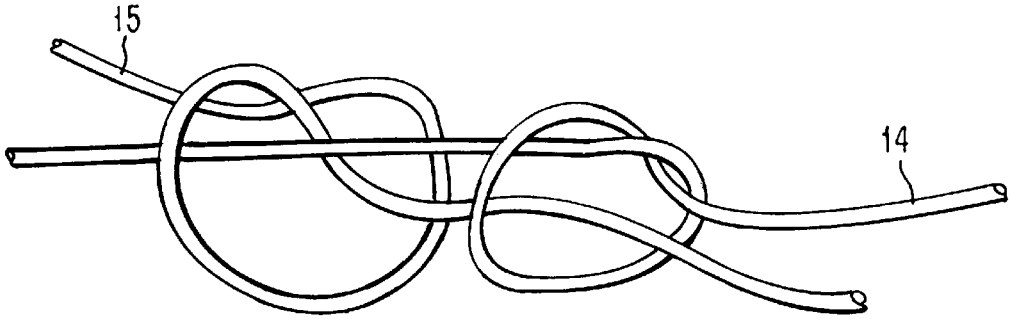
FIG. 6 is an illustration of a step in forming a knot used in the invention.
Figure 7:
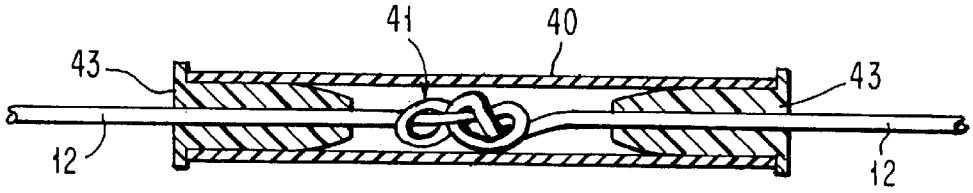
FIG. 7 is a cross-section of an alternative device according to the invention.

In an alternative embodiment, a self-tightening knot may be used to secure the free ends 14, 15 of cord 12 together, instead of clamps. An example of a self-tightening knot and how to form the same is shown in FIGS. 5–6. First a loop is formed with end 14 and end 14 is brought through the loop. End 15 is also inserted through the same loop, as shown in FIG. 5. Next, end 15 is wrapped over end 14 and then back under itself and end 14 to form a second loop. End 15 is inserted through the second loop, as shown in FIG. 6, and the knot mat be tightened. When ends 14, 15 and the cord 12 are stretched during use of the device, the knot becomes tighter, hence the term self-tightening. This provides a relatively easy and inexpensive method for construction. Of course many other know types of knots may also be used.

Additionally, in this embodiment barrier 34 may be provided around the knot to help prevent the knot from loosening. Preferably, the barrier is in this case shrink tubing which is shrunk at its center at an area surrounding the knot, but not at its ends. The shrink tubing will help keep the knot formed by ends 14, 15 centered in the handle 30. Coupling 16 may or may not be needed in this embodiment, depending on the stiffness provided by the shrink tubing used.

In a still further embodiment, a barrier 40 in the form of a hollow drop pipe such as a polyethylene pipe available from Polystar, Inc under the trade designation V-1015. In the embodiment described above, the barrier 40 will be approximately 4½–5½ inches long, with a hollow center core, approximately 0.622 inch or so in diameter, to fit around the outer surface 42 of the coupling 41. The free ends of the cord 12 can be coupled or secured together by a knot of the type disclosed along with a shrink tube around the knot to secure it and create a larger handle effect. In the alternative, the coupling 41 can employ a center-punch clamp. End caps 43 are provided to fit snuggly into the drop pipe 40. An example of an end cap is a ¾ inch carter socket. As with the other embodiments, it is preferred that barrier 40 is place within a foam material to form the handle.

Thus, a portable exercise device, which is easy to assemble, is provided. The device ensures the cord is secured in the coupling to prevent accidental separation. The device may easily be manufactured to provide different stretch resistances, so that people of varying size and strength may use it. Additionally, the device may easily be attached to a treadmill or stair-stepper to provide hand movement during treadmill or stair-stepper use, resulting in increased cardiovascular activity and a reduction in workout time. Moreover, the grip, including the coupling, clamp elements, etc. may be used on things other than elastic cords.

While a preferred embodiment of the invention has been described above, since variations in the invention will be apparent to those skilled in the art, the invention should not be construed as limited to the specific embodiment described above. For example, the materials used to construct the various elements of the invention may vary from those described above.

I claim:

1. A resistance exercise device, comprising:

at least one elastic resistance member for providing a resistance force and having a first end and a second end;

at least one hollow joining member that the first end and the second end of the resistance member are secured in, the joining member including a first end and a second end;

at least one securing member for securing the first end and the second end of the resistance member to the joining member by clamping around the joining member compressing it around the first end and the second end of the resistance member; and at least one hollow padded grip member for a user of the exercise device to grip, the grip member enclosing the joining member when the exercise device is in use.

2. The resistance exercise device according to claim 1, wherein the device includes a first securing member for securing the first end of the resistance member in the first end of the joining member by clamping and extending at least partially around the joining member and the resistance member, and a second securing member for securing the second end of the resistance member in the second end of the joining member by clamping and extending around at least partially through the joining member and the resistance member.

3. The resistance exercise device according to claim 2, wherein the first securing member and the second securing member are arranged near the ends of the joining member.

4. The resistance exercise device according to claim 1, wherein the hollow joining member is a deformable hose.

5. The resistance exercise device according to claim 2, wherein the first and second ends of the elastic resistance member extend into the hollow joining member beyond the first and second securing members, respectively.

6. The resistance exercise device according to claim 1, wherein the grip member is sufficiently wide such that a user of the exercise device can grip the grip member with two hands placed adjacent each other.

7. The resistance exercise device according to claim 1, further comprising:

two hollow padded grip members.

8. The resistance exercise device according to claim 1, further comprising:

two elastic resistance members.

9. The resistance exercise device according to claim 1, wherein the at least one securing member is a metal strip.

10. The resistance exercise device according to claim 9, wherein the metal strip forms at least one loop around the joining member.

11. The resistance exercise device according to claim 10 further comprising a fastener holding the loop together.

12. The resistance exercise device according to claim 1 further comprising plugs inserted into ends of the grip member.

13. The resistance exercise device according to claim 1 further comprising a barrier layer between the at least one securing member and the grip member.

14. An exercise device comprising:

a cord having two ends;

a coupling having an inner bore and receiving one of the ends at either side of the inner bore;

at least one clamp surrounding a portion of the coupling containing the cord, the clamp compressing a part of the coupling around the cord to secure the cord in the coupling; and a handle surrounding the hollow coupling.

15. The device of claim 14 wherein a portion of the cord extends into the coupling beyond the part of the coupling compressed by the clamp.

16. The device of claim 15 the portion of the cord has a diameter larger than a diameter of the part of the coupling compressed by the clamp.

17. The device of claim 14 wherein the clamp comprises a metal strip looped at least once around the coupling and a fastener holding the loop together.

18. The device of claim 14 further comprising a barrier layer arranged between the clamp and the handle.

19. The device of claim 14 further comprising end plugs arranged around the cord and inserted into ends of the handle.

20. The device of claim 18 wherein the barrier layer is a heat-shrinkable tube, which follows the contour of the clamp and coupling.

21. The device of claim 20 wherein the heat-shrinkable tube completely encircles the coupling between the ends of the coupling.

22. An exercise device comprising:

a cord having two ends;

a coupling having an inner bore and receiving one of the ends at either side of the inner bore;

at least one clamp surrounding a portion of the coupling containing the cord, the clamp compressing a part of the coupling around the cord to secure the cord in the coupling, wherein the clamp comprises a metal strip looped at least once around the coupling and a fastener holding the loop together.

* * * * *